US005148098A

United States Patent [19]

Draxelmayr

[11] Patent Number: 5,148,098

[45] Date of Patent: Sep. 15, 1992

[54] APPARATUS FOR STEPLESS CONTROL OF ELECTRIC LOADS BY THE PHASE ANGLE PRINCIPLE AND BRIGHTNESS CONTROLLER USING THE APPARATUS

[75] Inventor: Dieter Draxelmayr, Villach, Austria

[73] Assignee: Siemens Aktiengesellschaft, Munich, Fed. Rep. of Germany

[21] Appl. No.: 686,619

[22] Filed: Apr. 17, 1991

[30] Foreign Application Priority Data

Apr. 17, 1990 [DE] Fed. Rep. of Germany ..... 4012255

[51] Int. Cl.[5] ..... G05F 5/02

[52] U.S. Cl. ..... 323/237; 323/300; 323/320; 315/194; 315/291

[58] Field of Search ..... 323/235, 237, 241, 244, 323/300, 319, 320, 322, 323, 325; 307/262; 315/194, 291

[56] References Cited

U.S. PATENT DOCUMENTS 4,396,869 8/1983 Rosenbaum et al. ..... 315/194
4,688,161 8/1987 Covington ..... 323/235 X

FOREIGN PATENT DOCUMENTS 2362225 6/1975 Fed. Rep. of Germany .
2429763 4/1978 Fed. Rep. of Germany .
2543370 4/1981 Fed. Rep. of Germany .
3836128 7/1989 Fed. Rep. of Germany .
3839373 10/1989 Fed. Rep. of Germany .

OTHER PUBLICATIONS

"Elektronischer Helligkeitsregler mit Berührtaste", Kern/Strehle, 8136 Bauteile-Report Siemens, 15, Book 5 (1977), pp. 168-170.

*Primary Examiner*—Emanual T. Voeltz
*Attorney, Agent, or Firm*—Herbert L. Lerner; Laurence A. Greenberg

[57] ABSTRACT

An apparatus for stepless control of electric loads by the phase-angle principle includes a semiconductor switch element with main electrodes. A trigger circuit furnishes turn-on pulses for triggering the switch element and includes a detector for the polarity of an instantaneous value of an alternating voltage to be switched, a turn-on pulse pregenerator circuit for furnishing turn-on pulse suggestions, a switch and driver unit, and a decision stage. The decision stage may allow or prevent the turn-on pulse suggestions to be switched through to the switch element, as a function of whether an output signal of the detector has changed its polarity between two of the turn-on pulse suggestions. The decision stage may furnish a blocking signal at least at one input for preventing the turn-on pulse suggestions from being switched through to the switch element, upon the appearance of two turn-on pulse suggestions within one half-wave of the alternating voltage to be switched and in the absence of a turn-on pulse suggestion during one entire half-wave of the alternating voltage to be switched. For brightness control, a transformer has a secondary winding connected to an incandescent bulb and a primary winding connected to one pole of an alternating voltage source and to one main electrode, while another pole of the voltage source is connected to another main electrode.

10 Claims, 2 Drawing Sheets

Figure 1:
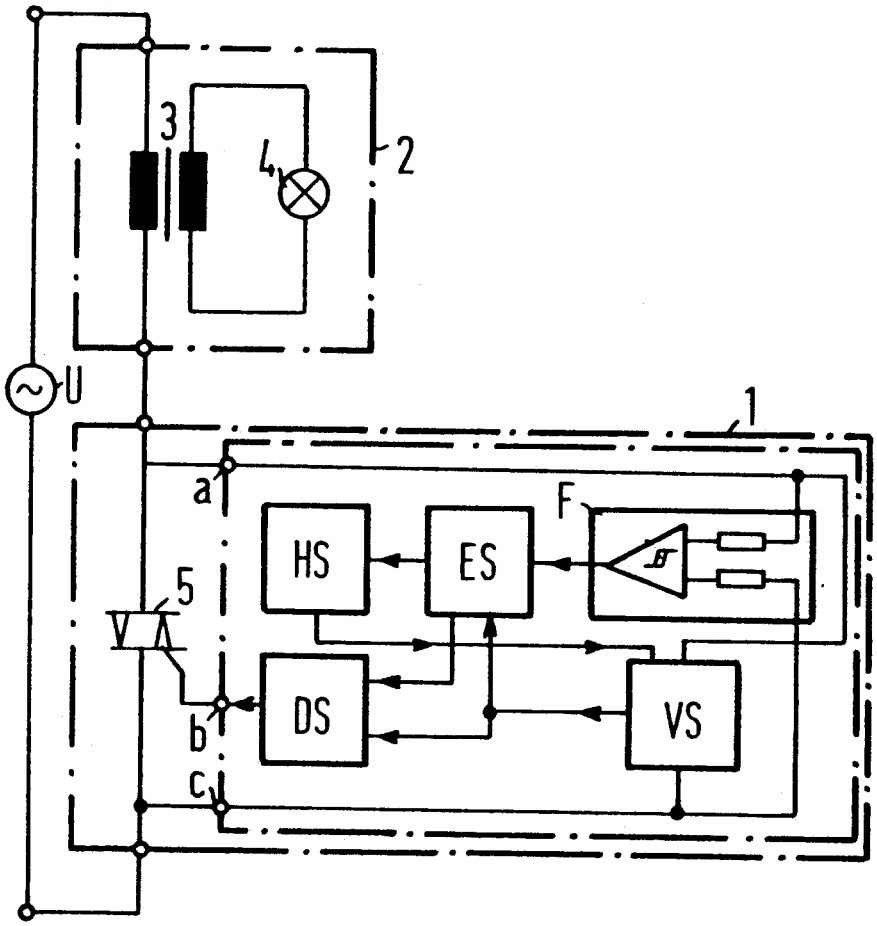

APPARATUS FOR STEPLESS CONTROL OF ELECTRIC LOADS BY THE PHASE ANGLE PRINCIPLE AND BRIGHTNESS CONTROLLER USING THE APPARATUS

The invention relates to an apparatus for stepless control of electric loads or consumers by the phase angle principle, having a semiconductor switch element and a trigger circuit for furnishing turn-on pulses provided for triggering the semiconductor switch element, the trigger circuit including at least one detector for detecting the polarity of the instantaneous value of an alternating voltage to be switched, a turn-on pulse pregenerator circuit for furnishing turn-on pulse suggestions, and a switch and driver unit. The invention also relates to a brightness controller using the apparatus.

Apparatus for stepless control of electric loads by the phase angle principle are known in principle and described, among other sources, in German Published, Non-Prosecuted Application DE-OS 23 62 225, in German Published, Prosecuted Applications DE-AS 24 29 763 and DE 25 43 370 B2, and in an article by Kern and Strehle entitled "Elektronischer Helligkeitsregler mit Berührtaste" [Electronic Brightness Control with Touch-sensitive Key], 8136 Bauteile-Report Siemens [Siemens Component Report], Vol. 15, No. 5 (1977.10), pp. 168–170. Such apparatus typically have a semiconductor switch element, for instance a triac, in the main current path. The semiconductor switch element is triggered by turn-on pulses, so that the current in the main current path, or the output current of the control apparatus is controllable as a function of the phase angle of the turn-on pulse. German Published, Non-Prosecuted Application DE 38 36 128 A1 shows a brightness control circuit for incandescent bulbs in which a self-locking field effect transistor is provided instead of a triac.

If the electric load that is triggered by such an apparatus has a different operating voltage than the mains voltage from which the apparatus is supplied, then a transformer may be provided in order to convert the voltage. In such circuits, the control apparatus supplies the primary winding of the transformer as if the primary winding represented a typical load. The actual load operated with a different operating voltage is then disposed in the secondary circuit of the transformer. Such a load may, for instance, be a halogen bulb, which is operated at low voltage and is supplied from a utility grid, for instance at 220 V alternating voltage, through a transformer, and is controllable in stepless fashion by a control apparatus. If the bulb is functioning properly, a circuit configuration, which includes a bulb and the secondary circuit of the transformer and in which the primary winding of the transformer is the load for the control apparatus, represents a virtually resistive load.

The voltage and current are in phase and operation with conventional control apparatus as described above is thus possible.

If the bulb fails in such a configuration, the following problems can arise:

depending on the turn-on time of the control apparatus, a very high magnetizing current can flow in the transformer. If that occurs repeatedly, for instance in a succession of a plurality of successive turn-on pulses at the power switch, then the transformer may be destroyed among other effects.

if the transformer core is magnetically saturated because of an unfavorable turn-on time in the remagnetization, then it causes current peaks because the load on the winding is then only resistive, particularly if the secondary winding is in a no-load state. It can also destroy the transformer. The known apparatus for controlling an electrical load does not prevent such problems with adequate reliability, at least if the apparatus operates according to the two-wire technique.

Examples of applications of the use of known control apparatus are conceivable in which a heat sensor is disposed on the transformer, for instance, which suppresses further turn-on pulses at the control apparatus if an allowable transformer temperature is exceeded. It is also conceivable for the current flowing in the electrical load to be detected and shut off if it exceeds an allowable maximum current.

German Published, Non-Prosecuted Application DE 38 39 373 A1 describes the brightness control circuit of German Published, Non-Prosecuted Application DE 38 36 128 A1, having a protection and limiting circuit, in which the output current of the brightness control circuit is measured and switched off if it exceeds a limit value. However, such protection circuits do not always reliably react in case of a problem if the onstate angle is unfavorable. A reliable circuit of that kind includes a fuse, which has to be replaced each time a bulb fails, so that such a circuit is very inconvenient.

An apparatus with a semiconductor switch element for the stepless control of electric loads by the phase angle principle that reliably shuts off at high currents dictated by the type of load, without having to replace a fuse, is conceivable. In such an apparatus, further triggering of the semiconductor switch element is suppressed whenever the current flow period of one half-wave exceeds a predetermined, maximally allowable value. In such an apparatus, an impermissibly high current occurs in only one half-wave, which typically does not yet cause the destruction of components. That apparatus is the subject of U.S. application Ser. No. 686,753, filed concurrently herewith.

All of the above-described apparatus for preventing malfunctions arising from overly high currents, which are caused by an inductive load or a resistive-inductive load, have in common the fact that they do not prevent further triggering of the load until an overly high current flows, at least briefly.

It is accordingly an object of the invention to provide an apparatus for stepless control of electric loads by the phase angle principle and a brightness controller using the apparatus, which overcome the hereinafore-mentioned disadvantages of the heretofore-known devices of this general type and which do so in such a way that the above-discussed problems are prevented with adequate reliability and without an impermissibly high current flow.

With the foregoing and other objects in view there is provided, in accordance with the invention, an apparatus for stepless control of electric loads by the phase-angle principle, comprising a semiconductor switch element; and a trigger circuit connected to the semiconductor switch element for furnishing turn-on pulses for triggering the semiconductor switch element; the trigger circuit including at least one detector for detecting a polarity of an instantaneous value of an alternating voltage to be switched and issuing an output signal, a turn-on pulse pregenerator circuit connected to the at least one detector for furnishing turn-on pulse suggestions, a switch and driver unit connected to the turn-on pulse pregenerator circuit, and a decision stage connected to the at least one detector and to the turn-on pulse pregenerator circuit for selectively allowing and preventing the turn-on pulse suggestions furnished by the turn-on pulse pregenerator circuit to be switched through to the semiconductor switch element, as a function of whether the output signal issued by the at least one detector has changed its polarity between two of the turn-on pulse suggestions furnished by the turn-on pulse pregenerator circuit.

With the objects of the invention in view, there is also provided an apparatus for stepless control of electric loads by the phase-angle principle, comprising a semiconductor switch element; and a trigger circuit connected to the semiconductor switch element for furnishing turn-on pulses for triggering the semiconductor switch element; the trigger circuit including at least one detector for detecting a polarity of an instantaneous value of an alternating voltage to be switched, a turn-on pulse pregenerator circuit connected to the at least one detector for furnishing turn-on pulse suggestions, a switch and driver unit connected to the turn-on pulse pregenerator circuit, and a decision stage connected to the turn-on pulse pregenerator circuit for furnishing a blocking signal at least at one input for preventing the turn-on pulse suggestions furnished by the turn-on pulse pregenerator circuit from being switched through to the semiconductor switch element, upon the appearance of two turn-on pulse suggestions furnished by the turn-on pulse pregenerator circuit within one half-wave of the alternating voltage to be switched and in the absence of a turn-on pulse suggestion furnished by the turn-on pulse pregenerator circuit during one entire half-wave of the alternating voltage to be switched.

In accordance with another feature of the invention, the turn-on pulse pregenerator circuit includes a phase-locked loop, and means for varying phase angles of the turn-on pulses for triggering the semiconductor switch element from values effecting a low current flow to values effecting a greater current flow, each time the apparatus is switched on.

In accordance with a further feature of the invention, the decision stage has an output, and the trigger circuit includes a hold stage connected to the decision stage and to the turn-on pulse pregenerator circuit for at least temporarily preventing issuance of turn-on pulse suggestions by the turn-on pulse pregenerator circuit, after appearance of a blocking signal at the output of the decision stage.

With the objects of the invention in view, there is further provided an apparatus for controlling the brightness of an incandescent bulb, comprising a transformer having a primary winding with two terminals and a secondary winding connected to an incandescent bulb, an alternating voltage source having two poles, one of the poles of the alternating voltage source being connected to one of the terminals of the primary winding of the transformer, a semiconductor switch element having one main electrode connected to the other of the terminals of the primary winding of the transformer and another main electrode being connected to the other of the poles of the alternating voltage source, and a trigger circuit according to one of the embodiments described above, being connected to the semiconductor switch element for furnishing turn-on pulses for triggering the semiconductor switch element.

The invention is based on the concept that impermissibly high currents as a consequence of an inductive load component, when the load is triggered by an apparatus with a semiconductor switch element for the stepless control of electric loads by the phase angle principle, cannot occur unless the period of time during which a semiconductor switch element contained in the control apparatus carries a current corresponding to a half-wave of current, referred to the supply voltage to be controlled, exceeds a value that corresponds to an angle of 180°. This can occur on one hand if the information on the supply voltage to be controlled does not vary within two successive turn-on pulses, which as a rule are offset by 180° from one another, or if the polarity of the supply voltage to be controlled varies twice in this period, so that an ensuing turn-on pulse would occur very early in a voltage half-wave, which would necessary cause an undesirably high current. Therefore, according to the invention, if two successive trigger pulses occur within the same half-period of the supply voltage to be controlled, and if no trigger pulse were to occur within one half-period of the supply voltage to be controlled, then this is taken as a criterion for the recognition of a possible malfunction.

An apparatus according to the invention recognizes these two conditions before the corresponding trigger pulses are switched to the semiconductor switch element, and is thus capable of preventing triggering of the semiconductor switch element before a problematically high current flows.

Depending on the use of a control apparatus according to the invention, it may be desirable for the control apparatus to automatically check the load state after interruption of triggering in a load-dictated malfunction to be expected, and if an allowable load state exists for the triggering to be automatically resumed. It may also be desirable for the control apparatus to automatically perform a certain number of attempts at startup after interruption of triggering, yet after several unsuccessful attempts at startup, or in other words if the load state has not become normal again within a certain period of time, further startup is only possible by external intervention. It may also be necessary for re-actuation to be only allowed manually after a malfunction.

A control apparatus according to the invention may be constructed in such a way that after interruption of triggering of the semiconductor switch element, it is either reactuatable only by external intervention, or it automatically restarts itself once it recognizes a normal load state, or it can no longer be automatically re-actuated but instead must be re-actuated by external intervention in the presence of an impermissible load state over a certain period of time.

Other features which are considered as characteristic for the invention are set forth in the appended claims.

Although the invention is illustrated and described herein as embodied in an apparatus for stepless control of electric loads by the phase angle principle and a brightness controller using the apparatus, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

The various reference numerals represent the following circuit units:

| | |
|---|---|
| 1 | control apparatus (apparatus for controlling 2) |
| 2 | electric load |
| 3 | transformer |
| 4 | resistive load, bulb |
| 5 | semiconductor switch element, triac |
| 6 | trigger circuit |
| U | alternating voltage source |
| ES | decision stage |
| HS | hold stage |
| F | detector of the polarity of the instantaneous output voltage of the voltage source U |
| DS | switch and driver unit |
| VS | turn-on pulse pregenerator circuit |
| CE1, . . . | basic counter element |
| IV1, . . . | inverter |
| AND | AND gate |
| NOR | NOR gate |
| EXNOR | EXNOR gate |
| NAND1, . . . | NAND gate |
| FF1, . . . | D-flip-flop |
| D | signal input of a D-flip-flop |
| CH | clock input of a D-flip-flop |
| QH | signal output of a D-flip-flop |
| RH | reset signal input of a D-flip-flop |
| a, c | connection terminal |
| b | turn-on pulse, output terminal |
| l | output terminal |
| d, e, f, | signal input terminal |
| g, h, i, k | signal input terminal |

Figure 2:
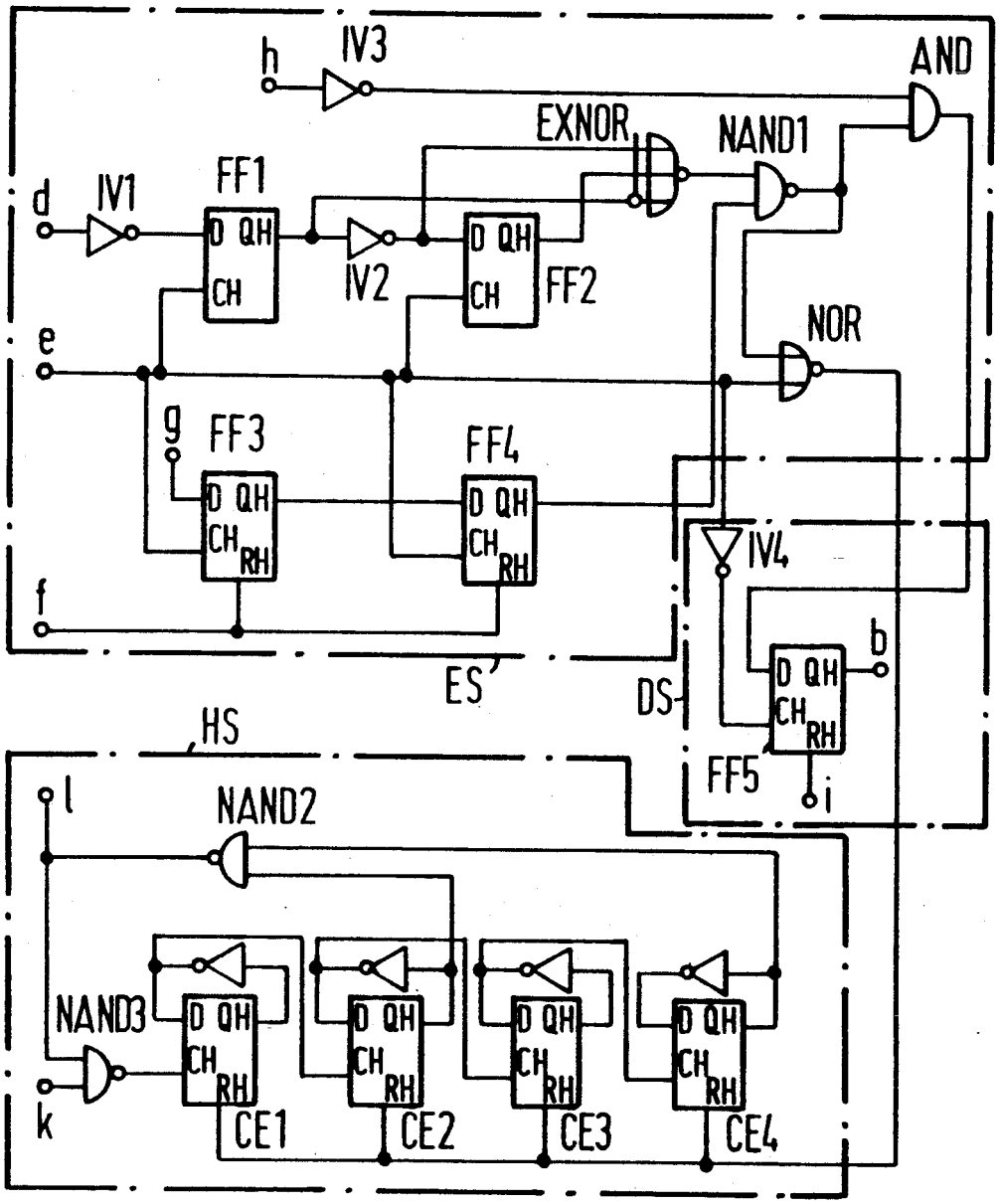

FIG. 1 is a basic schematic and block circuit diagram of an apparatus 1 for controlling an electric load by the phase angle principle, which is connected in series in a two-wire configuration with an electric load 2 and an alternating voltage source U supplying it, wherein the control apparatus 1 has a semiconductor switch element 5 and a trigger circuit 6 triggering it; and FIG. 2 is a basic schematic and block circuit diagram of a possible embodiment of the circuit elements of a trigger circuit 6 of FIG. 1 that are relevant to the invention.

Referring now in detail to the figures of the drawings, in which circuit elements of identical function are provided with the same reference numerals, and first, particularly, to FIG. 1 thereof, it is seen that the alternating voltage source U supplies the electric load 2. As an exemplary embodiment of an electric load, a transformer 3 is shown in this case, having a primary winding which has two terminals and which is supplied by the alternating voltage source U which has two poles, and a secondary winding to which a resistive load, for instance a bulb 4, is connected. The primary winding of the transformer 3 is connected directly to one connection terminal of the alternating voltage source U and it is connected through the control apparatus 1 to the other connection terminal of the alternating voltage source U. The semiconductor switch element 5 is connected into the current path between the alternating voltage source U and the electric load 2 in such a way that it can control the flow of current. A triac is shown in FIG. 1 as the semiconductor switch element 5. The triac is triggered by the trigger circuit 6 through a turn-on pulse output terminal b. The trigger circuit 6 is connected to one side of the semiconductor switch element 5 through a connection terminal a, and to the other side of the semiconductor switch element 5 through a connection terminal c. The trigger circuit includes a detector F for detecting the polarity of the instantaneous output voltage of the voltage source U, or the polarity of the instantaneous value of the alternating voltage to be switched by the semiconductor switch element 5. Such a detector F furnishes a logic signal at its output that is dependent on the instantaneous polarity of the supply voltage to be controlled of the electric load. One conceivable embodiment of such a detector is in the form of a Schmitt trigger, which is supplied by the alternating voltage source U or by the polarity of the instantaneous value of the alternating current to be switched by the semiconductor switch element 5. The Schmitt trigger thus recognizes whether the alternating voltage to be switched has a positive or a negative half-wave. If, as shown in FIG. 1, this Schmitt trigger detects the voltage applied to the semiconductor switch element 5 through the connection terminals a and c, then its hysteresis must be selected in such a way that with the semiconductor switch element in the conducting state, the previously detected information is maintained at the Schmitt trigger output. Moreover, the trigger circuit 6 also includes a turn-on pulse pregenerator circuit VS, which furnishes turn-on pulses at its output having a certain trigger angle, referred to the zero crossover of the supply voltage. The pulses, which are a sort of suggestion, are furnished as a function of a preselected variable, such as the output of a motor or the brightness of a bulb, and as a function of the supply voltage furnished by the alternating voltage source U. The turn-on pregenerator circuit VS can be constructed in a known manner, for instance in the manner used in the apparatus of the prior art discussed above. Often in such turn-on pulse pregenerator circuits VS, the phase information of the alternating voltage to be switched is simulated through a phase-locked loop or PLL, which then controls the phase angle as a function of certain parameters.

The signal output of the turn-on pulse pregenerator circuit VS and the signal output of the detector F are each connected to a respective input of a decision stage ES. This decision stage ES is constructed in such a way that when two turn-on pulse suggestions arrive at the output of the turn-on pulse pregenerator circuit VS within one half-wave of the supply voltage, and if there is no turn-on pulse suggestion at the output of the turn-on pulse pregenerator circuit VS during one full half-wave of the supply voltage, it furnishes a blocking signal at least at one output. The trigger element or circuit 6 in FIG. 1 also includes a switch and driver unit DS, having an output which is connected to the turn-on pulse output terminal b and thus to the control input of the semiconductor switch element. One input of the switch and driver unit DS is connected to the output of the turn-on pregenerator circuit VS. A further input of the switch and driver unit DS is connected to an output of the decision stage ES that furnishes a blocking signal in the event of a malfunction. The switch and driver unit DS is constructed in such a way that it carries the turn-on pulse suggestions furnished at the output of the turn-on pulse pregenerator circuit VS, possibly amplified, to the turn-on pulse output terminal b, and it prevents the turn-on pulse suggestion of the turn-on pulse pregenerator circuit from being switched through to the turn-on pulse output terminal b, at least if there is a blocking signal at its input connected to the decision stage ES.

Thus to this extent, FIG. 1 shows a special exemplary embodiment of a trigger circuit 6, in that the circuit also includes a hold stage HS, which can also act upon the turn-on pulse pregenerator circuit VS independently of the interruption of triggering of the semiconductor switch elements 5 performed by the switch and drive unit DS in the event of a malfunction recognized by the decision stage ES. If such a hold stage HS is provided, then it can, for instance, prevent the output of further turn-on pulse suggestions by the turn-on pulse pregenerator circuit VS, at least for a certain time or until some given event occurs. With the aid of a hold stage HS that is activated after the recognition of a malfunction by the decision stage ES, automatic restarting of an apparatus according to the invention can also be controlled. In order to interrupt the output of a turn-on pulse to the turn-on pulse output terminal b once a turn-on pulse suggestion has been made by the turn-on pulse pregenerator circuit VS followed by a malfunction ascertained by the decision stage ES, such a hold stage HS is not necessary. In a conceivable embodiment of an apparatus according to the invention, a hold stage HS can also be part of the decision stage ES, or if an output signal of the decision stage is delivered to the turn-on pulse pregenerator circuit VS, then such a hold stage can be part of the turn-on pulse pregenerator circuit VS.

If the phase information of the alternating voltage to be switched is simulated through a PLL that controls the phase angle of the turn-on pulse suggestions delivered by the turn-on pulse pregenerator circuit VS in an apparatus according to the invention, then for reliable operation of an apparatus according to the invention it is recommended that the phase angle of the turn-on pulses furnished at the turn-on pulse output terminal b be varied continuously or in stages, from values effecting a low current flow to values effecting a greater current flow, each time the apparatus is turned on, until the desired phase angle is attained. In other words, the control apparatus is not turned on directly with the desired phase angle. A low current flow brings about a phase angle of virtually 180° in this case, referred to the previous zero crossover of the alternating voltage to be switched. In fact, the phase-locked loop of the turn-on pulse pregenerator circuit VS can not recognize a zero crossover of the alternating voltage to be switched unless the current through the semiconductor switch element 5 has become 0 or nearly 0. In the case of a resistive load, the zero crossover of the alternating voltage to be switched and the zero crossover of the switched current are the same. With an inductive load component, the zero crossover of the current is delayed relative to the zero crossover of the alternating voltage to be switched. The delay is dependent on the inductive component of the load and on the phase angle of the turn-on pulse that controls the semiconductor switch element 5. Accordingly, the zero crossovers detected by the phase-locked loop are dependent on the type of load and on the phase angle with which the semiconductor switch element 5 is triggered. On the other hand, the phase angle with which the semiconductor switch element 5 is triggered becomes dependent on the zero crossovers detected by the phase-locked loop of the turn-on pulse pregenerator circuit VS. This interaction occurring at least with the control apparatus 1 connected in two-wire configurations, can be advantageously exploited in circuits according to the invention. In this connection, the subsequent discussion will address the behavior of a control apparatus according to the invention for various load states, on the condition that the control apparatus runs up in the form of a so-called soft start each time it is switched on. This means that each time the control apparatus 1 is switched on, the trigger circuit 6 outputs turn-on pulses to the semiconductor switch element 5 having a phase angle which is varied in such a way that immediately after the apparatus is switched on, the on-state duration of the semiconductor switch element per half-wave is short and then becomes longer, continuously or in stages, until the desired phase angle and thus the desired current flow in the semiconductor switch element 5 is attained.

If a control apparatus 1 according to the invention is provided for triggering an electric load 2 in the form of a resistive load under the aforementioned conditions, then the trigger circuit 6 controls the semiconductor switch element 5 without difficulty, as the current becomes greater, until the desired phase angle and thus the desired current are attained. The decision stage ES does not detect a malfunction that would cause the interruption of the triggering of the semiconductor switch element 5 in either the startup phase or in further operation with the desired phase angle.

Even if a control apparatus 1 according to the invention triggers a resistive-inductive load or an inductive load as an example of an electric load 2, and if the desired phase angle upon triggering of the selected load would not lead to an impermissibly high current, then soft starting of the control apparatus 1 and operation of the control apparatus with the applicable load at the corresponding, uncritical phase angle, are possible.

If the desired phase angle would lead to an impermissibly high current with an inductive load or a resistive-inductive load, or in other words if at this phase angle either two turn-on pulses or no turn-on pulses would be output to the semiconductor switch element within one half-wave of the alternating voltage to be controlled, then a soft start up to the attainment of a critical phase angle would have to be possible, in the event that the phase-locked loop in the turn-on pulse pregenerator circuit VS were to lock directly on the output voltage of the supplying alternating voltage source U, which is possible with a three-wire configuration. However, if the control apparatus 1 and the electric load 2 are connected in a two-wire configuration and the aforementioned interaction exists between the alternating voltage to be switched and the phase angle of the turn-on pulses switched to the semiconductor switch element, a control oscillation occurs in the control apparatus 1 according to the invention having a phase-locked loop, and this oscillation makes itself felt in a phase oscillation of the phase-locked loop. As a result, shortly after the beginning of the soft start, the decision stage ES already recognizes a grid half-wave without a turn-on pulse. Since this is a criterion for recognizing a defective operating state, further triggering of the semiconductor switch element 5 is suppressed, at least temporarily, through the switch and driver unit DS.

If an apparatus 1 for stepless control of electric loads by the phase angle principle were switched on abruptly without soft starting, with a turn-on pulse pregenerator circuit VS that includes a phase-locked loop, then because of the ensuing transient behavior of the phase-locked loop, even if the load is purely resistive, this could cause a mistaken determination of a fault situation by the decision stage ES.

FIG. 2 is a basic circuit diagram showing particularly advantageous embodiments of a decision stage ES, a hold stage HS and the portion of a switch and driver unit DS which is essential to the invention.

The decision stage ES shown in FIG. 2 has a signal input terminal d, which is acted upon by the output signal of the detector F having the polarity of the instantaneous output voltage of the voltage source U.

In the exemplary embodiment shown, the signal input terminal d is connected to a signal input D of a D-flip-flop FF1, through an inverter IV1. This inverter is unnecessary for the function of the circuit but does not impede it, either. The flip-flop FF1, along with three further flip-flops FF2, FF3 and FF4, are D-flip-flops triggered at the rising edge. Clock inputs CH of these four D-flip-flops FF1, FF2, FF3 and FF4 are each connected to a signal input terminal e. This signal input terminal e is acted upon with turn-on pulse suggestions that are furnished by the turn-on pregenerator circuit of FIG. 1. The signal input D of the D-flip-flop FF3 is connected to a signal input terminal g, which is permanently acted upon by a potential that defines a logical 1. A signal output QH of the D-flip-flop FF3 is connected to the signal input D of the D-flip-flop FF4. The signal output QH of the D-flip-flop FF4 is connected to a first input of a first NAND gate NAND1. The D-flip-flop FF3 and the D-flip-flop FF4 are resettable, and each have one reset signal input RH for this purpose. The letter H shown in some of the reference symbols in the logic circuits of FIG. 2, means that this input is activated with a high level, or as applicable this output furnishes a high level in the activated state. The reset signal inputs RH of the flip-flops FF3 and FF4 are connected in common to a signal input terminal f, which is acted upon with a logic signal, as a function of the activation state of the control apparatus 1 of FIG. 1, in such a manner that the flip-flops FF3 and FF4 are reset after each activation of the control apparatus. This assures that after an activation of the control apparatus 1 of FIG. 1, one input of the first NAND gate NAND1 is not enabled through the flip-flop FF4, in a decision stage ES of FIG. 2, until the second turn-on pulse suggestion from a turn-on pulse pregenerator circuit VS has been switched to the signal input terminal e. The signal output QH of the flip-flop FF1 in FIG. 2 is connected directly to one inverting input of an EXNOR gate EXNOR. It is also connected through an inverter IV2 to the signal input D of the flip-flop FF2, as well as to a non-inverting input of the same EXNOR gate EXNOR. A further non-inverting input of the EXNOR gate EXNOR is connected to the signal output QH of the flip-flop FF2.

Given a suitable selection of the logical relationships, the inverter IV2 can be dispensed with in this case, and the inverting input of the EXNOR gate EXNOR is dispensed with as well. The signal output of the EXNOR gate EXNOR is connected to a second signal input of the first NAND gate NAND1.

The above-described circuit always furnishes a logical 0 at the signal output of the first NAND gate NAND1 whenever, after the turn-on of the control apparatus and thus after the resetting of the flip-flops FF3 and FF4, at least two turn-on pulse suggestions have been furnished at the signal input terminal e and whenever the signal connected by the detector at the signal input terminal d upon two successive turn-on pulse suggestions connected to the signal input terminal e, does not differ in its logic level. Thus the signal output of the first NAND gate NAND1 is suitable as a signal output of a decision stage ES of FIG. 1, and a 1 at the output of this decision stage enables of the proposed turn-on pulse to be switched through on the part of the switch and drive unit DS.

In the embodiment shown in FIG. 2, the signal output of the decision stage ES that is connected to the switch and driver unit DS is formed by the signal output of an AND gate AND. One input of this AND gate AND is connected to the output of the first NAND gate NAND1. The other input of this AND gate AND is connected through an inverter IV3 to a signal input terminal h. In a particular embodiment of a control apparatus according to the invention, the input terminal h may be acted upon by a logic signal in such a way that a logical 1 is represented whenever the semiconductor switch element 5 is in the on state.

In an apparatus according to the invention, information on the state of the alternating voltage to be switched is present at the signal input terminal d in FIG. 2. The two flip-flops FF1 and FF2 form a shift register in which this information is shifted onward. A shift clock is formed by a turn-on pulse suggestion furnished by the turn-on pulse pregenerator circuit VS. Depending on the state of the EXNOR gate EXNOR, the decision stage ES furnishes a logical 1 or a logical 0 at its output. Since correct malfunction recognition by the decision stage ES after an activation of the control apparatus 1 is not possible until after the second turn-on pulse, the output of the decision stage ES is blocked through the flip-flops FF3 and FF4 for the first turn-on pulse after the control apparatus 1 has been turned on.

The embodiment of a decision stage ES shown in FIG. 2 also has a signal output for connection to a hold stage ES. The signal output of the first NAND gate NAND1 could be provided as this signal output. However, during the shifting process in the shift register formed by the flip-flops FF1 and FF2, the signal level indicating a malfunction can mistakenly occur briefly at the output of the first NAND gate NAND1. In order to prevent activation of the hold stage HS in this case, the signal output of a NOR gate NOR is provided as the signal output for acting upon the hold stage HS, in the illustrated embodiment shown of the decision stage ES. One input of this NOR gate is connected to the signal input terminal e, and the other input of this NOR gate is connected to the output of the first NAND gate NAND1. Activation of the hold stage HS during a shift process, or in other words when there is a high level of the signal input terminal e, is prevented as a result.

The switch and driver unit DS shown in FIG. 2 is merely a basic circuit diagram of the portion of the switch and driver unit DS which is essential to the invention. It is assumed that a resettable D-flip-flop FF5 that is shown is suitable for furnishing a turn-on pulse, which is required for triggering a semiconductor element at its signal output QH, that is formed by the turn-on pulse output terminal b. The signal input D of the D-flip-flop FF5 is connected to the output of the AND gate of the decision stage ES. The clock input CH of the flip-flop FF5 is connected to the signal input terminal e through an inverter IV4 and thus is acted upon by the turn-on pulse suggestions of the turn-on pulse pregenerator circuit VS of FIG. 1. The reset input RH of the flip-flop FF5 is connected to a signal input terminal i. The signal input terminal i is acted upon by a clock signal that is coupled with the clock of the turn-on pulse pregenerator circuit VS, in such a manner as to be suitable for resetting the flip-flop FF5 after each turn-on pulse has been switched through.

The flip-flop FF5 connects a turn-on pulse suggestion that is present at the signal input terminal e to the turn-on pulse output terminal b, only if the decision stage ES switches a corresponding signal to the signal input D of the flip-flop FF5, or in other words when the decision stage ES is not detecting any malfunction.

The embodiment of a hold stage HS shown in FIG. 2 primarily includes a resettable counter, which locks at a certain counter state and does not begin to run again until a reset signal arrives. The embodiment shown uses four basic counter elements CE1, CE2, CE3 and CE4 for this purpose, each of which is formed by one resettable D-flip-flop having a signal output QH which is fed back through an inverter to a signal input D. The signal input D forms the output of the basic counter element CE1, . . . , and the clock input CH of a basic counter element CE2, CE3, and CE4 is connected to the respective signal output of the previous basic counter element CE1, CE2 and CE3. The clock input CH of the first basic counter element CE1 is acted upon by a clock signal. An output terminal 1 is provided as the output of the hold stage HS, which is connected to the signal output of a second NAND gate NAND2 and is also connected to one signal input of a third NAND gate NAND3. The other input of this third NAND gate NAND3 is connected to a signal input terminal k, which is acted upon by a clock signal. This clock signal should typically be in a fixed ratio to the frequency of the alternating voltage to be switched. The output of the third NAND gate NAND3 is connected to the clock input CH of the first basic counter element CE1. As a result, a blocking signal at the output terminal 1 of the hold stage HS prevents further counting of the counter. The signal inputs of the second NAND gate NAND2 are connected to respective signal outputs QH of flip-flops contained in the basic counter elements CE2, CE4. The selection of the basic counter elements CE1, CE2, having flip-flop signal outputs QH at which the inputs of the second NAND gate NAND2 are connected, defines the counter state at which the output 1 of the hold stage HS is acted upon by a blocking signal.

FIG. 2 merely shows exemplary embodiments of possible logic circuits. Naturally, one skilled in the art can achieve the same logical relationships by using arbitrary logic elements. Although only one connection is shown as the turn-on pulse output terminal b in FIGS. 1 and 2, this does not preclude the provision of a terminal with two connections, depending on the type of semiconductor switch element 5 to be triggered by this turn-on pulse output terminal.

If a malfunction is recognized, the hold stage HS can be activated by the decision stage ES, and for as long as it is activated it can prevent further output of turn-on pulse suggestions by the turn-on pulse pregenerator circuit VS. This process can be time-limited by suitably constructing the hold stage HS in such a way that after a certain time elapses, turn-on pulse suggestions can again be furnished by the turn-on pulse pregenerator circuit VS, and the trigger circuit 6 will thereupon undertake an attempt at starting. If a malfunction still prevails when this attempt at starting is made, then no turn-on pulses are carried to the turn-on pulse output terminal b, and the hold stage HS once again suppresses the output of the turn-on pulse suggestion by the turn-on pulse pregenerator circuit VS for a certain period of time. After the blocking defined by the hold stage HS has elapsed, if the apparatus is turned on again and no malfunction prevails, then the control apparatus 1 can operate in the normal mode.

If an apparatus according to the invention is used for stepless control of an electric motor by the phase angle principle, then automatic re-actuation after a malfunction may be recommended, at least for a limited number of attempted re-actuations.

If an apparatus according to the invention is used for stepless control of incandescent bulbs by the phase angle principle, or in other words as a brightness control, then re-actuation of the trigger circuit after detection of a malfunction according to the invention may not be appropriate in each case, at least if the incandescent bulb is triggered through a transformer. If a malfunction based on a defective incandescent bulb is effected and the triggering of the semiconductor switch element 5 was suppressed in an apparatus according to the invention, it may possibly be desirable for the incandescent bulb not to be triggered immediately after insertion into the socket after the defective bulb has been replaced. In that case it is suitable for the trigger circuit 6 not to be turned-on automatically again after a malfunction occurs. If other, temporary disruptions occur, it may be suitable to provide that in the case of a malfunction, a limited number of automatic attempts at re-actuation are performed, after the suppression of the triggering of the semiconductor switch element 5, and that automatic re-actuation is prevented after a certain number of unsuccessful attempts at re-actuation, in order not to have re-actuation dependent on manual interventions.

I claim:

1. An apparatus for stepless control of electric loads by the phase-angle principle, comprising a semiconductor switch element; and a trigger circuit connected to said semiconductor switch element for furnishing turn-on pulses for triggering said semiconductor switch element; said trigger circuit including at least one detector for detecting a polarity of an instantaneous value of an alternating voltage to be switched and issuing an output signal, a turn-on pulse pregenerator circuit connected to said at least one detector for furnishing turn-on pulse suggestions, a switch and driver unit connected to said turn-on pulse pregenerator circuit, and a decision stage connected to said at least one detector and to said turn-on pulse pregenerator circuit for selectively allowing and preventing the turn-on pulse suggestions furnished by said turn-on pulse pregenerator circuit to be switched through to said semiconductor switch element, as a function of whether the output signal issued by said at least one detector has changed its polarity between two of the turn-on pulse suggestions furnished by said turn-on pulse pregenerator circuit.

2. The apparatus according to claim 1, wherein said turn-on pulse pregenerator circuit includes a phase-locked loop, and means for varying phase angles of the turn-on pulses for triggering said semiconductor switch element from values effecting a low current flow to values effecting a greater current flow, each time the apparatus is switched on.

3. The apparatus according to claim 1, wherein said decision stage has an output, and said trigger circuit includes a hold stage connected to said decision stage and to said turn-on pulse pregenerator circuit for at least temporarily preventing issuance of turn-on pulse suggestions by said turn-on pulse pregenerator circuit, after appearance of a blocking signal at the output of said decision stage.

4. The apparatus according to claim 2, wherein said decision stage has an output, and said trigger circuit includes a hold stage connected to said decision stage and to said turn-on pulse pregenerator circuit for at least temporarily preventing issuance of turn-on pulse suggestions by said turn-on pulse pregenerator circuit, after appearance of a blocking signal at the output of said decision stage.

5. An apparatus for stepless control of electric loads by the phase-angle principle, comprising a semiconductor switch element; and a trigger circuit connected to said semiconductor switch element for furnishing turn-on pulses for triggering said semiconductor switch element; said trigger circuit including at least one detector for detecting a polarity of an instantaneous value of an alternating voltage to be switched, a turn-on pulse pregenerator circuit connected to said at least one detector for furnishing turn-on pulse suggestions, a switch and driver unit connected to said turn-on pulse pregenerator circuit, and a decision stage connected to said turn-on pulse pregenerator circuit for furnishing a blocking signal at least at one input for preventing the turn-on pulse suggestions furnished by said turn-on pulse pregenerator circuit from being switched through to said semiconductor switch element, upon the appearance of two turn-on pulse suggestions furnished by said turn-on pulse pregenerator circuit within one half-wave of the alternating voltage to be switched and in the absence of a turn-on pulse suggestion furnished by said turn-on pulse pregenerator circuit during one entire half-wave of the alternating voltage to be switched.

6. The apparatus according to claim 5, wherein said turn-on pulse pregenerator circuit includes a phase-locked loop, and means for varying phase angles of the turn-on pulses for triggering said semiconductor switch element from values effecting a low current flow to values effecting a greater current flow, each time the apparatus is switched on.

7. The apparatus according to claim 5, wherein said decision stage has an output, and said trigger circuit includes a hold stage connected to said decision stage and to said turn-on pulse pregenerator circuit for at least temporarily preventing issuance of turn-on pulse suggestions by said turn-on pulse pregenerator circuit, after appearance of a blocking signal at the output of said decision stage.

8. The apparatus according to claim 6, wherein said decision stage has an output, and said trigger circuit includes a hold stage connected to said decision stage and to said turn-on pulse pregenerator circuit for at least temporarily preventing issuance of turn-on pulse suggestions by said turn-on pulse pregenerator circuit, after appearance of a blocking signal at the output of said decision stage.

9. An apparatus for controlling the brightness of an incandescent bulb, comprising a transformer having a primary winding with two terminals and a secondary winding connected to an incandescent bulb, an alternating voltage source having two poles, one of said poles of said alternating voltage source being connected to one of said terminals of said primary winding of said transformer, a semiconductor switch element having one main electrode connected to the other of said terminals of said primary winding of said transformer and another main electrode being connected to the other of said poles of said alternating voltage source, and a trigger circuit connected to said semiconductor switch element for furnishing turn-on pulses for triggering said semiconductor switch element, said trigger circuit including at least one detector for detecting a polarity of an instantaneous value of an alternating voltage to be switched and issuing an output signal, a turn-on pulse pregenerator circuit connected to said at least one detector for furnishing turn-on pulse suggestions, a switch and driver unit connected to said turn-on pulse pregenerator circuit, and a decision stage connected to said at least one detector and to said turn-on pulse pregenerator circuit for selectively allowing and preventing the turn-on pulse suggestions furnished by said turn-on pulse pregenerator circuit to be switched through to said semiconductor switch element, as a function of whether the output signal issued by said at least one detector has changed its polarity between two of the turn-on pulse suggestions furnished by said turn-on pulse pregenerator circuit.

10. An apparatus for controlling the brightness of an incandescent bulb, comprising a transformer having a primary winding with two terminals and a secondary winding connected to an incandescent bulb, an alternating voltage source having two poles, one of said poles of said alternating voltage source being connected to one of said terminals of said primary winding of said transformer, a semiconductor switch element having one main electrode connected to the other of said terminals of said primary winding of said transformer and another main electrode being connected to the other of said poles of said alternating voltage source, and a trigger circuit connected to said semiconductor switch element for furnishing turn-on pulses for triggering said semiconductor switch element; said trigger circuit including at least one detector for detecting a polarity of an instantaneous value of an alternating voltage to be switched, a turn-on pulse pregenerator circuit connected to said at least one detector for furnishing turn-on pulse suggestions, a switch and driver unit connected to said turn-on pulse pregenerator circuit, and a decision stage connected to said turn-on pulse pregenerator circuit for furnishing a blocking signal at least at one input for preventing the turn-on pulse suggestions furnished by said turn-on pulse pregenerator circuit from being switched through to said semiconductor switch element, upon the appearance of two turn-on pulse suggestions furnished by said turn-on pulse pregenerator circuit within one half-wave of the alternating voltage to be switched and in the absence of a turn-on pulse suggestion furnished by said turn-on pulse pregenerator circuit during one entire half-wave of the alternating voltage to be switched.

* * * * *